United States Patent [19]

Hutcheon

[11] 3,935,552

[45] Jan. 27, 1976

[54] TWO REFERENCE CAVITY STRUCTURE FOR FREQUENCY TRACKING AS A FUNCTION OF TEMPERATURE

[75] Inventor: Ronald M. Hutcheon, Deep River, Canada

[73] Assignee: Atomic Energy of Canada Limited, Ottawa, Canada

[22] Filed: Mar. 17, 1975

[21] Appl. No.: 559,257

[30] Foreign Application Priority Data

Nov. 18, 1974 Canada ..... 214017

[52] U.S. Cl. ..... 333/82 B; 331/69; 331/96; 331/176; 333/82 BT; 333/83 T

[51] Int. Cl.[2] ..... H01P 1/30; H01P 7/04

[58] Field of Search ..... 333/82 BT, 83 T, 82 B; 331/69, 96, 101, 176; 324/95

[56] References Cited

UNITED STATES PATENTS

| | | | |
|---|---|---|---|
| 3,577,100 | 5/1971 | Askew et al. | 333/83 T X |
| 3,848,201 | 11/1974 | Presser | 331/96 X |

*Primary Examiner*—Paul L. Gensler
*Attorney, Agent, or Firm*—Edward Rymek

[57] ABSTRACT

A two reference cavity structure for tracking the frequency of a high power liquid cooled cavity structure, consisting of two low power cavities tuned to frequencies slightly above and slightly below the resonant frequency of the high power structure. Each of the cavities has a first and a second section, with the first sections maintained at a first temperature and the second sections maintained at a second temperature such that the reference cavities track the frequency shifts in the high power structure caused by temperature differentials between regions of that high power structure. The first section of each reference cavity may have a cylindrical outer wall and a first end wall whose temperature is governed by the temperature of the liquid coolant before it enters the high power structure. The second section may include a second end wall having a boss projecting into the cavity of the first section, the temperature of the second section being controlled by the liquid coolant after it exits from the high power structure.

7 Claims, 4 Drawing Figures

TWO REFERENCE CAVITY STRUCTURE FOR FREQUENCY TRACKING AS A FUNCTION OF TEMPERATURE

This invention is directed to an apparatus for tracking the frequency of a high power cavity structure and in particular to a two reference cavity structure which tracks the high power cavity frequency as a function of its temperature.

High power cavity structures, such as an accelerator structure, are energized by RF power sources such as magnetrons. In order to maintain high efficiency however, the power source must be monitored continuously and its frequency adjusted to the resonant frequency of the power cavity structure. Presently this is accomplished in a tracking apparatus which includes two reference cavities whose resonant frequencies are located approximately equal distances above and below the resonant frequency of the power cavity structure. A small amount of RF power is equally coupled into each of these reference cavities and the power level in each cavity is measured by detectors. The output signals from the detectors are equal only when the RF source is at the desired resonant frequency and therefore may be used in a feedback circuit to the RF source to adjust its frequency in order to equalize the power level in each cavity.

In an attempt to have reference cavities which will track the resonant frequency of the high power cavity structure, the resonant frequency of which is temperature dependent, the outlet cooling fluid from the high power structure is made to circulate around the two reference cavities. This provides some resonant frequency shift in the reference cavities when the resonant frequency shift occurs in the high power structure. However, it has been found that the change in the resonant frequency in the high power structure as a function of output water temperature usually does not match the reference cavities. In addition, the temperature-frequency coefficient of the reference cavities is fixed by the choice of cavity material. These problems are caused by the fact that the high power cavity structure, when in operation, cannot be cooled uniformly.

Using a linear accelerator structure as an example, the cooling fluid is found to maintain the walls of the accelerator at a lower temperature than that of the tips of the beam path openings through the cavity walls. These temperature differences cause frequency shifts which cannot be related to the average temperature of the high power structure.

It is therefore an object of this invention to provide a novel two reference cavity structure for monitoring the frequency of an RF source.

It is a further object of this invention to provide a two reference cavity structure capable of tracking the resonant frequency of a high power fluid cooled cavity structure.

It is a further object of this invention to provide a two reference cavity structure capable of tracking the resonant frequency of a high power fluid cooled cavity structure operating in any given RF mode over a broad range of ambient temperatures and power dissipation in the high power structure.

These and other objects are achieved in a two reference cavity structure which consists of two low power cavities tuned to frequencies slightly above and slightly below the resonant frequency of a high power liquid cooled cavity structure. Each of the cavities has a first and a second section, with the first section maintained at a first temperature and the second section maintained at a second temperature such that the reference cavities track the frequency shifts in the high power cavity structure due to temperature differentials between regions of that high power structure. Each cavity may be formed by a first section which includes a cylindrical outer wall and first end wall whose temperature is controlled by the liquid coolant before it enters the high power structure, and by a second section which includes a second end wall having a boss projecting into the cavity, the temperature of the second section being controlled by the liquid coolant after it exits from the high power structure. Power may be coupled to the cavities and power levels within the cavities may be measured by probes located in openings located in the cylindrical outer walls. Tuning of the cavities may be accomplished by tuning plungers located in the first end walls of the cavities or by mechanical indentation of these walls.

IN THE DRAWINGS

Figure 1:
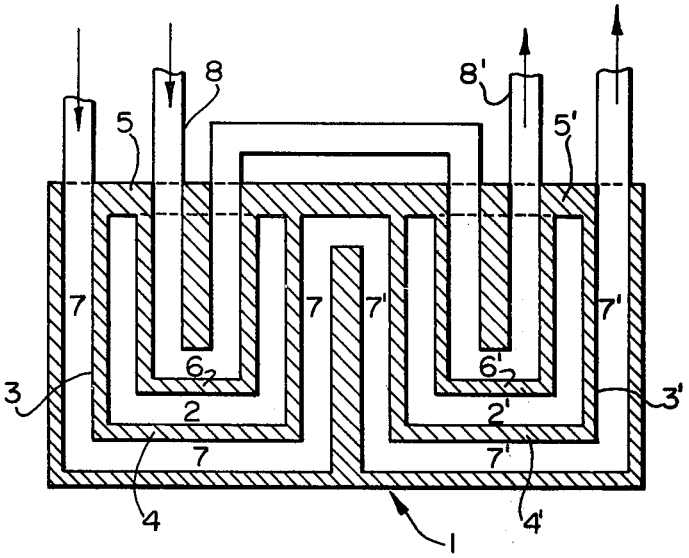
FIG. 1 illustrates a cross section of a basic two reference cavity system.

The principles of the invention will be described with reference to FIG. 1. The two reference cavity structure 1 consists of two identical re-entrant coaxial cavities 2 and 2'. Each cavity 2, (2') includes an outer wall 3, (3'), end walls 4, (4') and 5, (5') and an inner boss 6, (6') joined to one of the end walls. The walls 3, (3'), 4, (4') and 5, (5') as well as the boss 6, (6') are preferably made of the same conductor material as the high power cavity. The two cavities 2, 2' may be completely separate or they may be jointed by a common wall. Further, each cavity 2, (2') has a first channel 7, (7') in the cavity walls 3, (3'), 4, (4') and a second channel 8, (8') in the cavity boss 6, (6'). The channels 7 and 7' are connected in series, as are channels 8 and 8' to form two continuous channels through the two cavities.

The invention is based on two principles:

1. If all the linear dimensions of a cavity resonator are changed by a constant factor the resonant frequencies of all the normal modes in the cavity will be scaled by the same factor. Thus if a cavity undergoes a uniform change in temperature of 1°, the percentage change in frequency is given by the thermal expansion coefficient of the material expressed in percent.

2. If a given temperature difference is established between two regions of a cavity then, within limits, any desired frequency change may be had by choice of cavity shape and mechanical construction.

The first principle is relied on in prior art two cavity tracking structures in that it assumes that any temperature changes in the entire high power cavity structure will be uniform throughout the structure. This assumption is only accurate when no RF power is applied to a high power structure. However, as in the present invention, frequency shifts due to a change in input coolant temperature may be tracked accurately.

The second principle is relied on in this invention in that the frequency shift due to the temperature difference between regions in the high power cavity structure is tracked by having the high power cavity structure input coolant liquid pass through one region of the two reference cavity structure before it enters the high power cavity structure and by having the output coolant liquid from the high power cavity structure pass through a second region of the two reference cavity structure. The input coolant may be passed through channel 7–7' and the output coolant through channel 8–8', as shown on FIG. 1, which will provide a frequency shift in the two reference cavity structure due to regional temperature differences. The input coolant and the output coolant channels in the two reference cavity structure may however by reversed to provide a frequency-temperature coefficient of the same magnitude but opposite sign.

Accurate frequency is obtained by designing the reference cavities such that the input-output coolant temperature difference produces a change in the frequency of the reference cavities which matches the change in the high power structure. In addition it is preferred that the high power cavity structure and the reference cavities be made of the same material, such as copper, that one reference cavity be tuned slightly above the high power structure frequency and the other cavity an equal amount below that frequency, and that the coolant flow rates through the high power structure and the reference cavities be such that with no RF power, they are essentially at coolant temperature.

The selection of cavity dimensions can be made using well established reference data such as the data on resonant cavities listed in the book "Microwave Transmission Design Data" by Theordore Moreno on pages 217 to 230.

Figure 2:
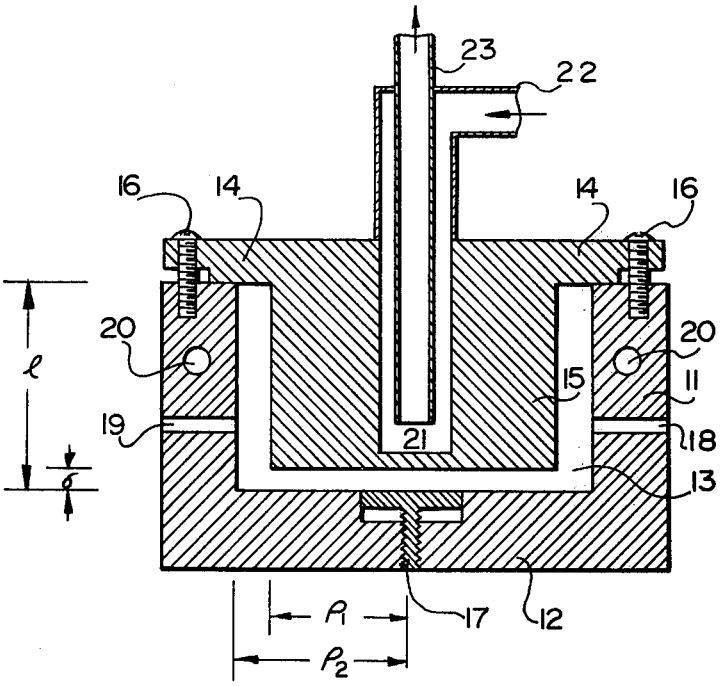
FIG. 2 illustrates a cross-section view of a single cavity in accordance with the invention.

FIG. 2 illustrates, in cross-section, one embodiment of a reference cavity in accordance with this invention. It consists of side walls 11 and an end wall 12 forming a cylindrical chamber 13. A second end wall 14 with an elongated boss 15 is fixed to the open end of the cylindrical chamber 13 by screws 16. The reference cavity is finely tuned in any conventional manner such as by a tuning plunger 17. The side wall 11 includes a first opening 18 through which RF power is coupled to the cavity and a second opening 19 in which a probe may be inserted to measure the power level in the cavity. The side wall further includes a cooling channel 20 through which coolant fluid may be circulated. Finally a second cooling channel 21 is formed in the boss 15 through the end wall 14, having a coolant inlet pipe 22 and outlet pipe 23.

Figure 3:
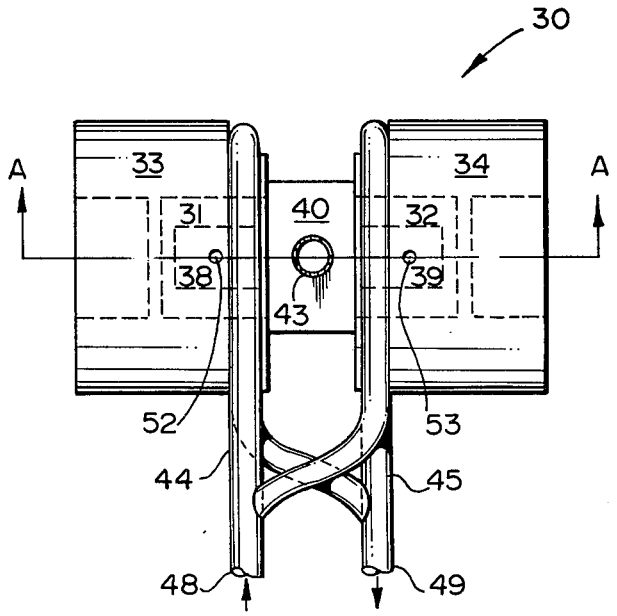
FIG. 3 illustrates an embodiment of a two reference cavity structure.
Figure 4:
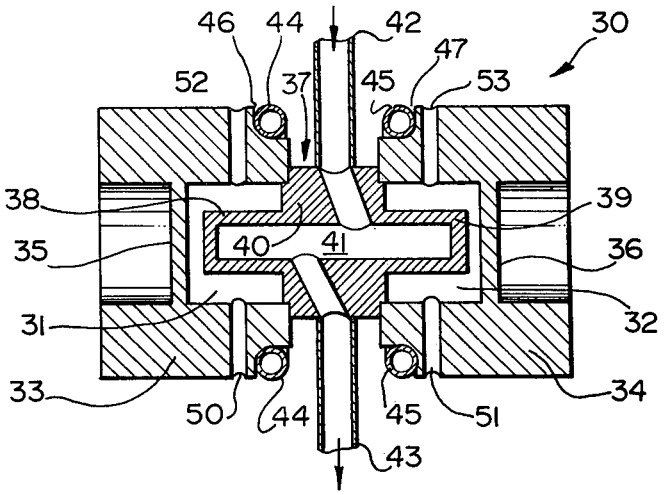
FIG. 4 illustrates a cross reference view of the structure in FIG. 3, taken along plane A—A.

For s-band operation, to provide a copper cavity which has a central frequency of approximately 3 GHz and a frequency-temperature coefficient of approximately −125kHz per degree C. temperature differential between the boss 15 and the outer walls 11, the following cavity dimensions were used:

boss radius — $\rho_1 = 0.300$ inch
cavity radius — $\rho_2 = 0.470$ inch
chamber length — $l = 0.690$ inch
spacing between boss and end wall — $\delta = 0.080$ inch An embodiment of a combined two reference cavity structure 30 in accordance with this invention is shown in FIGS. 3 and 4. The two cavities 31, 32 are formed using two identical cylindrical chambers having outer walls 33 and 34 respectively and end walls 35 and 36 respectively. The end walls are located within the cylinders to protect them from accidental blows which would disturb the tuning of the cavity. A single boss element 37 made of the same material as the cavity walls, consists of a first cylindrical boss 38 and a second cylindrical boss 39 which are joined by an enlarged center section 40. The bosses 38, 39 are inserted into the chambers 31, 32 respectively with the outer walls joined to the center section 40. The boss element further includes a coolant channel 41 with inlet pipe 42 and outlet pipe 43. This channel may take many shapes, however, it is desirable to have both bosses 38 and 39 maintained at the same temperature. For simplicity of construction, the boss element 37 may be made in two half sections, the channel 41 drilled and the half sections joined, as by brazing or any other conventional manner.

Coolant channels 44 and 45 may be formed within the outer walls 33, 34 respectively or for simplicity, they may consist of copper tubes in intimate contact with these walls within grooves 46 and 47 respectively. The ends of the tubes 44, 45 are joined to form a coolant inlet 48 and a coolant outlet 49. Holes 50 and 51 are drilled through outer walls 33 and 34 respectively to receive probes which will couple low power to the cavities. Further holes 52 and 53 are drilled through outer walls 33 and 34 respectively to receive power level measurement probes. Tuning plungers may be inserted into end walls 35 and 36, however for simplicity of construction, the cavities 31 and 32 may initially be cut slightly high in frequency, and after assembly, tuning may be done by mechanically indenting the end walls 35 and 36.

Finally for greater accuracy in frequency tracking by this two reference cavity structure of a high power evacuated cavity structure such as an accelerator, it is desirable that the hermetic sealing of the reference cavities be done in a controlled temperature-humidity atmosphere chosen to match exactly the accelerator and the reference cavities frequency-temperature coefficients.

I claim:

1. A two reference cavity structure for tracking the resonant frequency of a high power liquid cooled cavity structure comprising:

a first reference cavity having a first and second section, said first cavity tuned to a frequency below said resonant frequency;

a second reference cavity having a first and second section, said second cavity tuned to a frequency above said resonant frequency;

first means adapted to maintain said first sections at a first temperature; and second means adapted to maintain said second sections at a second temperature.

2. A two reference cavity structure as claimed in claim 1 wherein:

said first means includes channel means within said first sections adapted to receive the liquid coolant before it enters said high power structure; and said second means includes channel means within second sections adapted to receive the liquid coolant after it exits said high power structure.

3. A two reference cavity structure as claimed in claim 2 wherein each of said first sections include a cylindrical outer wall and a first end wall positioned at one end of said cylindrical outer wall; and each of said second sections includes a second end wall positioned at the other end of said cylindrical outer wall to form a closed cavity, said second end wall having a cylindrical boss projecting into said closed cavity.

4. A two reference cavity structure as claimed in claim 3 wherein said second end wall of said first cavity is integrally fixed to said second end wall of said second cavity.

5. A two reference cavity structure as claimed in claim 4 wherein each of said first sections includes a first opening adapted to receive a first probe to couple energy to said cavity and a second opening adapted to receive a second probe to measure power level in said cavity.

6. A two reference cavity structure as claimed in claim 5 wherein each of said first end wall includes tuning means for tuning said cavity.

7. A two reference cavity structure as claimed in claim 5 wherein each of said cavities is adapted to be tuned by mechanical indentation of said first end walls.

* * * * *